US010888120B2

(12) United States Patent
Zuber

(10) Patent No.: US 10,888,120 B2
(45) Date of Patent: Jan. 12, 2021

(54) NON-TOBACCO NICOTINE CONTAINING ARTICLE

(71) Applicant: Philip Morris Products S.A., Neuchatel (CH)

(72) Inventor: Gerard Zuber, Froideville (CH)

(73) Assignee: Philip Morris Products S.A., Neuchatel (CH)

( * ) Notice: Subject to any disclaimer, the term of this patent is extended or adjusted under 35 U.S.C. 154(b) by 254 days.

(21) Appl. No.: 15/101,316

(22) PCT Filed: Dec. 4, 2014

(86) PCT No.: PCT/EP2014/076650
§ 371 (c)(1),
(2) Date: Jun. 2, 2016

(87) PCT Pub. No.: WO2015/082652
PCT Pub. Date: Jun. 11, 2015

(65) Prior Publication Data

US 2016/0295926 A1 Oct. 13, 2016

(30) Foreign Application Priority Data

Dec. 5, 2013 (EP) ..... 13195953

(51) Int. Cl.
*A24F 47/00* (2020.01)
*A24B 15/16* (2020.01)

(52) U.S. Cl.
CPC ..... *A24F 47/008* (2013.01); *A24B 15/165* (2013.01); *A24F 47/004* (2013.01); *A24F 47/006* (2013.01)

(58) Field of Classification Search
None
See application file for complete search history.

(56) References Cited

U.S. PATENT DOCUMENTS 5,203,355 A * 4/1993 Clearman ..... A24B 15/165 131/194
5,441,060 A 8/1995 Rose et al.
5,613,505 A * 3/1997 Campbell ..... A24F 47/008 128/202.21

(Continued)

FOREIGN PATENT DOCUMENTS

CH 691 156 A5 5/2001
CN 1126426 A 7/1996

(Continued)

OTHER PUBLICATIONS

International Search Report dated Mar. 18, 2015 in PCT/EP2014/076650 filed on Dec. 4, 2014.

(Continued)

*Primary Examiner* — Phu H Nguyen
(74) *Attorney, Agent, or Firm* — Oblon, McClelland, Maier & Neustadt, L.L.P.

(57) ABSTRACT

An aerosol-generating rod is provided, including a gathered sheet of non-tobacco material circumscribed by a wrapper. The sheet of non-tobacco material includes a sorbent substrate such as paper, a nicotine salt, and an aerosol-former. The sheet of non-tobacco material is textured or crimped. An aerosol-generating article is also provided, including the aerosol-generating rod as a component element.

15 Claims, 3 Drawing Sheets

(56) References Cited

U.S. PATENT DOCUMENTS

Figure 1:
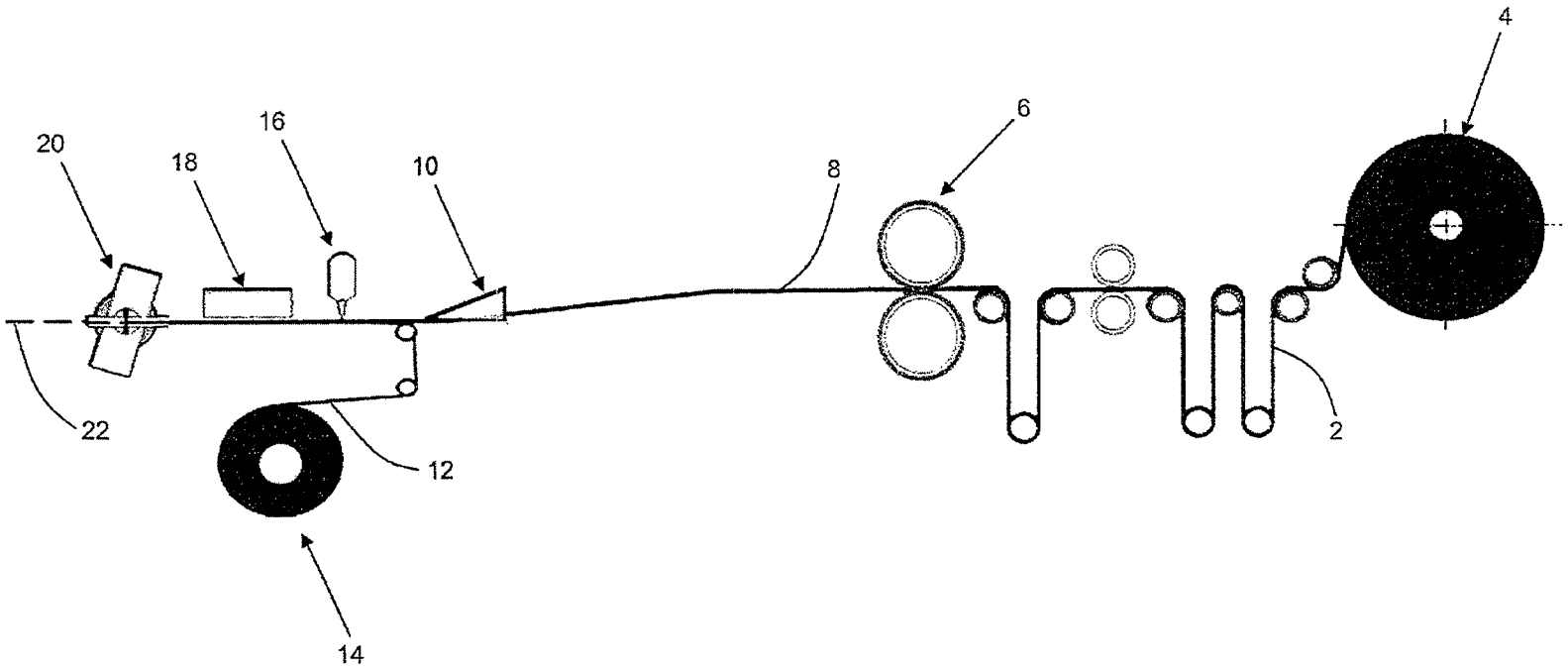

| | | | | |
|---|---|---|---|---|
| 5,687,746 | A | 11/1997 | Rose et al. | |
| 5,746,227 | A | 5/1998 | Rose et al. | |
| 5,778,899 | A | 7/1998 | Saito et al. | |
| 5,845,649 | A * | 12/1998 | Saito | A24B 15/165 131/194 |
| 6,595,209 | B1 | 7/2003 | Rose et al. | |
| 2006/0283468 | A1 | 12/2006 | Lipowicz | |
| 2011/0041861 | A1* | 2/2011 | Sebastian | A24F 47/006 131/365 |
| 2013/0074854 | A1 | 3/2013 | Lipowicz | |
| 2013/0233329 | A1 | 9/2013 | Sebastian et al. | |
| 2014/0305448 | A1* | 10/2014 | Zuber | A24F 47/004 131/328 |
| 2014/0345630 | A1 | 11/2014 | Lipowicz | |

FOREIGN PATENT DOCUMENTS

| | | | |
|---|---|---|---|
| CN | 1044436 | C | 8/1999 |
| CN | 102481021 | A | 5/2012 |
| EP | 0 822 670 | A2 | 2/1998 |
| JP | 8-511175 | A | 11/1996 |
| JP | 3118462 | B2 | 10/2000 |
| JP | 2008-538782 | A | 11/2008 |
| JP | 2015-523857 | A | 8/2015 |
| TW | 201043157 | A1 | 12/2010 |
| WO | 2006/070288 | A2 | 7/2006 |
| WO | WO 2009/022232 | A2 | 2/2009 |
| WO | WO 2009/132793 | A1 | 11/2009 |
| WO | WO 2010/113702 | A1 | 10/2010 |
| WO | WO 2013/098405 | A2 | 7/2013 |

OTHER PUBLICATIONS

Written Opinion dated Mar. 18, 2015 in PCT/EP2014/076650 filed on Dec. 4, 2014.

Combined Chinese Office Action an Search Report dated May 11, 2018 in corresponding Patent Application No. 201480062126.X (with English Translation), 20 pages.

Office Action dated Oct. 1, 2018 in Japanese Patent Application No. 2016-522110 (with English translation), 13 pages.

Combined Chinese Office Action and Search Report dated Dec. 3, 2018, in Patent Application No. 201480062126.X (with English translation), 24 pages.

* cited by examiner

NON-TOBACCO NICOTINE CONTAINING ARTICLE

The present specification relates to aerosol-generating rods comprising gathered sheets of a non-tobacco nicotine-bearing material for use in aerosol-generating articles. The specification also relates to aerosol-generating articles comprising such aerosol-generating rods as aerosol-forming substrates.

So-called 'e-cigarettes' and other electrically operated smoking systems that vaporise a liquid nicotine formulation to form an aerosol that is inhaled by a user are known in the art. For example, WO 2009/132793 A1 discloses an electrically heated smoking system comprising a shell and a replaceable mouthpiece wherein the shell comprises an electric power supply and electric circuitry. The mouthpiece comprises a liquid storage portion, a capillary wick having a first end that extends into the liquid storage portion for contact with liquid therein, and a heating element for heating a second end of the capillary wick. In use, liquid is transferred from the liquid storage portion towards the heating element by capillary action in the wick. Liquid at the second end of the wick is vaporised by the heating element.

Most current commercial e-cigarettes or electronic nicotine delivery systems (ENDSs) fail to deliver more than 50 μg nicotine per puff, under the Health Canada intense smoking regime. Typically, the mean nicotine delivery per puff for ENDSs ranges from 20 to 30 μg nicotine per puff. A few studies report that ENDSs deliver little nicotine to the blood. Nicotine pharmacokinetics data on naïve or first time ENDS users show very low plasma nicotine concentrations in the range of 0.5 ng/mL to 3.5 ng/mL, which compares to typical plasma nicotine concentrations resulting from tobacco cigarette smoking of 10 to 20 ng/mL. However, a more recent study on "experienced" ENDS users (i.e. users who had been using ENDS for about 1 year) indicated a significant increase in plasma nicotine concentration (Cmax=10.3 ng/mL), which almost matches pharmacokinetic data of conventional cigarette smokers. The explanation of this observed discrepancy in plasma nicotine concentrations between "naïve" and "experienced" ENDS users may be that, as recent studies have shown, average puff duration is significantly longer for "experienced" ENDS users (puff duration=4.2+/−0.7 s) in comparison to "naïve" ENDS users (puff duration=2.4+/−0.5 s). This is believed to be because "naïve" ENDS users have the tendency to smoke ENDS in the same way as a conventional tobacco cigarette (puff duration=2.1+/−0.4 s). Because they take longer and deeper puffs, "experienced" ENDS users may reach nicotine deliveries and plasma nicotine levels similar to the levels reached by conventional tobacco cigarette smokers.

Further studies have shown that the vast majority of experienced ENDS users use e-cigarette models that are generally large in size, with high battery power. Based on these recent studies, it appears that long-term ENDS users are opting for more powerful devices, such as tank systems, with higher nicotine deliveries and are adapting their "vaping" topography in order to reach plasma nicotine levels similar to tobacco cigarette smoking. The adaptation to a new smoking/vaping ritual may be cumbersome for some ENDS users and may have implications in the formation of undesirable compounds. For example, longer puff durations and greater puff volumes may induce the phenomena of "dry puff".

Furthermore, commercial e-cigarettes involve the use of a liquid nicotine containing substrate. The handling of such liquids may be cumbersome or undesirable for an end user.

It would be desirable to provide rods comprising non-tobacco nicotine-bearing material for use in aerosol-generating articles. It would further be desirable to provide aerosol-generating articles that provide a similar nicotine delivery to conventional cigarettes without the need to use bulky aerosol-generating devices.

An aerosol-generating rod may be provided comprising a gathered sheet of non-tobacco material circumscribed by a wrapper. The sheet of non-tobacco material is textured or crimped and comprises a sorbent substrate, a nicotine salt, and an aerosol-former. The gathered sheet of material non-tobacco preferably extends along substantially the entire length of the aerosol-generating rod and across substantially the entire transverse cross-sectional area of the aerosol-generating rod. The sheet may further comprise water.

The sheet may further comprise a flavourant. The flavourant may comprise a volatile flavour component. The flavourant may comprise menthol. As used herein, the term 'menthol' denotes the compound 2-isopropyl-5-methylcyclohexanol in any of its isomeric forms. The flavourant may provide a flavour selected from the group consisting of menthol, lemon, vanilla, orange, wintergreen, cherry, and cinnamon.

As the nicotine and aerosol former are absorbed or coated onto a sorbent substrate, an aerosol-generating article comprising the aerosol-generating rod does not comprise flowable liquid. Thus, an end user need not be concerned with handling of liquid formulations. Furthermore, the nicotine salts may produce a nicotine bearing aerosol at low temperatures compared with heated aerosol generating articles that heat a tobacco substrate. Thus, an aerosol-generating rod may form a nicotine bearing aerosol when heated to temperatures lower than 300° C., for example lower than 250° C., or lower than 220° C. A nicotine bearing aerosol may be generated at temperatures as low as 120-140° C. Thus, there is no need to use a cumbersome aerosol generating device to generate an aerosol with high levels of nicotine.

Preferably the sheet of non-tobacco material comprises one or more nicotine salt selected from the list consisting of nicotine citrate, nicotine pyruvate, nicotine bitartrate, nicotine pectates, nicotine aginates, and nicotine salicylate. Nicotine in these salt forms is more stable than liquid freebase nicotine typically used in e-cigarettes. Thus, aerosol-generating articles comprising the aerosol-generating rods may have longer shelf lives than typical e-cigarettes.

As used herein, an "aerosol former" is any suitable known compound or mixture of compounds that, in use, facilitates formation of a dense and stable aerosol and that is substantially resistant to thermal degradation at the operating temperature of the aerosol-generating article. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine, Preferably, the aerosol former is one or more aerosol former selected from the list consisting of propylene glycol, triethylene glycol, 1,3-butanediol, and glycerine.

The nicotine and the aerosol-former may be combined with water as a liquid formulation. The liquid formulation may further comprise a flavourant. Such a liquid formulation may then be absorbed by a sorbent substrate or coated onto the surface of a substrate.

The sorbent substrate may be a sheet of cellulosic-based material onto which the nicotine salt and the aerosol former may be coated or absorbed. For example, the sorbent substrate may be a sheet of paper.

Preferably the ratio of aerosol-former to nicotine in the sheet of non-tobacco material is lower than 15:1. For example, the ratio of aerosol-former to nicotine in the sheet of non-tobacco material may be between 3:1 and 10:1, for example about 4:1, or 5:1, or 6:1. E-cigarettes typically utilize a liquid aerosol-forming substrate that has an aerosol former to nicotine ratio in the range between 20:1 and 100:1. On heating such formulations, an aerosol may be developed that has a low nicotine concentration. This may, in turn, result in users drawing deeper and longer puffs to provide a desired nicotine intake.

The aerosol-generating rod may comprise at least one further sheet of material, the further sheet of material gathered together with the sheet of non-tobacco material and circumscribed by the wrapper. The further sheet may comprise a flavourant. The further sheet may be a thermally conductive material to improve thermal transfer through the aerosol-generating rod. The further sheet may be or comprise a material that is susceptible to induction to allow it to be used in inductive heating of the aerosol-generating rod. The further sheet may be a metal foil, for example aluminium foil.

The aerosol-generating rod may comprise one or more susceptor elements for inductive heating. Such susceptor elements may be incorporated into the aerosol-generating rod as threads or wires of suitable susceptor material. Such susceptor elements may be incorporated on or in the sheet of non-tobacco material, for example susceptor elements may be printed onto a surface of eth sheet of non-tobacco material.

As used herein, the term 'rod' is used to denote a generally cylindrical element of substantially circular, oval or elliptical cross-section.

As used herein, the term 'sheet' denotes a laminar element having a width and length substantially greater than the thickness thereof. The width of a sheet is greater than 10 mm, preferably greater than 20 mm or 30 mm.

As used herein, the term "aerosol-forming material" denotes a material that is capable of releasing volatile compounds upon heating to generate an aerosol. An aerosol-forming substrate may comprise or consist of an aerosol-forming material.

As used herein, the term 'aerosol-generating rod' is used to denote a generally cylindrical element of substantially circular, oval or elliptical cross-section that comprises or consists of an aerosol-forming material.

As used herein, the term 'rod length' denotes the dimension in the direction of the cylindrical axis of rods as described herein.

As used herein, the term 'gathered' denotes that the sheet of tobacco material is convoluted, folded, or otherwise compressed or constricted substantially transversely to the cylindrical axis of the rod.

As used herein, the terms 'upstream' and 'downstream' are used to describe the relative positions of components, or portions of components, of aerosol-generating articles comprising rods as described herein in relation to the direction of air drawn through the aerosol-generating articles during use thereof.

The aerosol-generating rods comprise a gathered textured sheet of non-tobacco nicotine-bearing material circumscribed by a wrapper. Use of a textured sheet of material may advantageously facilitate gathering of the sheet to form an aerosol-generating rod.

As used herein, the term 'textured sheet' denotes a sheet that has been crimped, embossed, debossed, perforated or otherwise deformed. Textured sheets material may comprise a plurality of spaced-apart indentations, protrusions, perforations or a combination thereof.

As used herein, the term 'crimped sheet' is intended to be synonymous with the term 'creped sheet' and denotes a sheet having a plurality of substantially parallel ridges or corrugations. Preferably, the crimped sheet of material has a plurality of ridges or corrugations substantially parallel to the cylindrical axis of the aerosol-generating rod. This advantageously facilitates gathering of the crimped sheet of material to form the aerosol-generating rod.

Sheets of non-tobacco material for use in the production of aerosol-generating rods may be textured using suitable known machinery for texturing filter tow, paper and other materials.

Sheets of non-tobacco material for use in the invention may be crimped using a crimping unit of the type described in CH-A-691156, which comprises a pair of rotatable crimping rollers. However, it will be appreciated that sheets of non-tobacco material may be textured using other suitable machinery and processes that deform or perforate the sheets material.

Aerosol-generating rods may be produced using conventional cigarette filter making machinery.

For example, rods comprising a gathered crimped sheet of non-tobacco material may be produced using machinery for forming filter rods comprising a gathered crimped sheet of paper of the type described in CH-A-691156.

A method of forming an aerosol-generating rod may comprising the steps of: providing a continuous sheet of non-tobacco material; gathering the continuous sheet of non-tobacco material transversely relative to the longitudinal axis thereof; circumscribing the gathered continuous sheet of non-tobacco material with a wrapper to form a continuous rod; and severing the continuous rod into a plurality of discrete aerosol-generating rods. The non-tobacco material comprises a sorbent substrate, a nicotine salt, and an aerosol former.

The method may further comprise the step of coating the sorbent substrate with the nicotine salt and the aerosol-former. The method may comprise the step of absorbing the nicotine salt and the aerosol-former into the sorbent substrate. Preferably, aerosol-generating rods as described herein are of substantially uniform cross-section.

Aerosol-generating rods as described herein for use as aerosol-forming substrates in heated aerosol-generating articles may typically have a rod length of between about 5 mm and about 20 mm or about 30 mm.

Preferably, sheets of material for use in forming aerosol-generating rods as described herein have a width of at least about 25 mm.

In certain embodiments sheets of material for use in aerosol-generating rods as described herein may have a width of between about 25 mm and about 300 mm.

Preferably, the sheets of material that make up the aerosol-generating rod have a thickness of at least about 50 μm to about 300 μm.

Aerosol-generating rods as described herein may comprise a gathered sheet of non-tobacco material circumscribed by a porous wrapper or a non-porous wrapper.

An aerosol-generating rod as described may be particularly beneficial as a component of an aerosol-generating article, particularly a heated aerosol-generating article. A preferred use of an aerosol-generating rod as described above is as an aerosol-forming substrate of a heated aerosol-generating article. An aerosol-generating article may be provided comprising an aerosol-generating rod as described above as a component element.

Heated aerosol-generating systems operate by heating an aerosol-forming substrate to generate an aerosol from the substrate. The aerosol can then be inhaled by a consumer. On heating a substrate comprising an aerosol-generating rod as described herein, an inhalable aerosol comprising nicotine and an aerosol-former is generated.

A number of aerosol-generating articles in which an aerosol-forming substrate is heated rather than combusted have been proposed in the art. Typically in heated aerosol-generating articles, an aerosol is generated by the transfer of heat from a heat source, for example a chemical, electrical or combustible heat source, to a physically separate aerosol-generating substrate, which may be located within, around or downstream of the heat source.

As used herein, the term 'aerosol-generating substrate' denotes a substrate formed from or comprising an aerosol-forming material that is capable of releasing volatile compounds upon heating to generate an aerosol.

In one embodiment, aerosol-generating rods as described herein may be used as aerosol-generating substrates in heated aerosol-generating articles comprising a combustible heat source and an aerosol-generating substrate downstream of the combustible heat source.

For example, aerosol-generating rods as described herein may be used as aerosol-generating substrates in heated aerosol-generating articles of the type disclosed in WO-A-2009/022232, which comprise a combustible carbon-based heat source, an aerosol-generating substrate downstream of the combustible heat source, and a heat-conducting element around and in contact with a rear portion of the combustible carbon-based heat source and an adjacent front portion of the aerosol-generating substrate. However, it will be appreciated that aerosol-generating rods as described herein may also be used as aerosol-generating substrates in heated aerosol-generating articles comprising combustible heat sources having other constructions.

In another embodiment, aerosol-generating rods as described herein may be used as aerosol-generating substrates in heated aerosol-generating articles for use in electrically-operated aerosol-generating systems in which the aerosol-generating substrate of the heated aerosol-generating article is heated by an electrical heat source.

For example, aerosol-generating rods as described herein may be used as aerosol-generating substrates in heated aerosol-generating articles of the type disclosed in EP-A-0 822 670.

An aerosol generating rod may be one of a number of component elements of an aerosol-generating article. For example, an aerosol-generating article may comprise an aerosol-generating rod as described herein and one or more other elements assembled within a cigarette paper. The one or more other elements may include a mouthpiece, an aerosol-cooling element, an a support element such as a hollow acetate tube. In one embodiment an aerosol-generating article may comprise, in a linear sequential arrangement, an aerosol-forming substrate formed from an aerosol-generating rod, a support element located immediately downstream of the aerosol-forming substrate, an aerosol-cooling element located downstream of the support element, and an outer wrapper circumscribing the aerosol-forming substrate, the support element and the aerosol-cooling element. The aerosol-forming substrate may be penetrable by the heating element of an aerosol-generating device.

A system may be provided comprising an electrically-operated aerosol-generating device or apparatus and an aerosol-generating article for use with the apparatus. The aerosol-generating article comprises an aerosol-generating rod as described herein. The aerosol-generating device may comprise a heating element designed to be inserted into the aerosol-generating article. The aerosol-generating device may comprise a heating element designed to surround a portion of the aerosol-generating article. In certain embodiments of a system, the aerosol-generating device may comprise an induction element for inductively heating a susceptor comprised in the aerosol-generating article.

Figure 2:
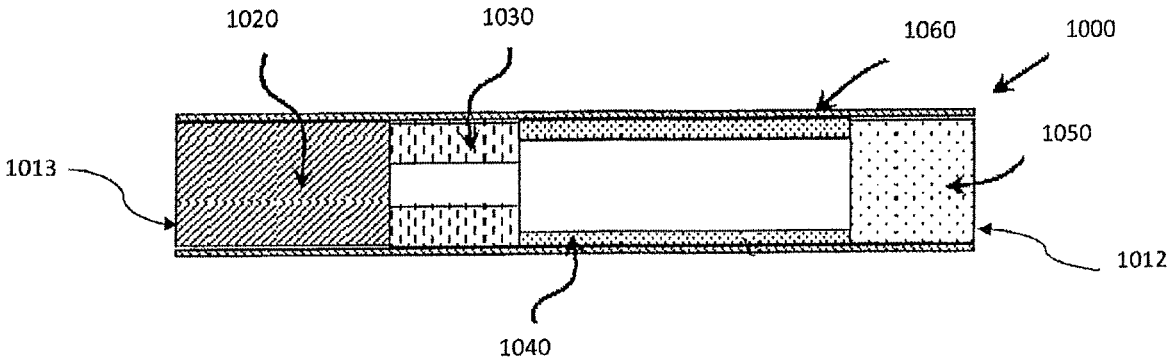
Figure 3:
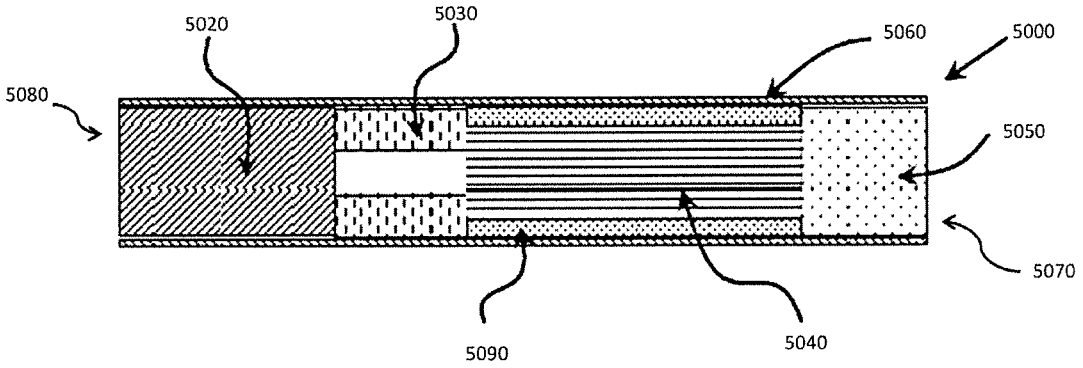
Figure 4:
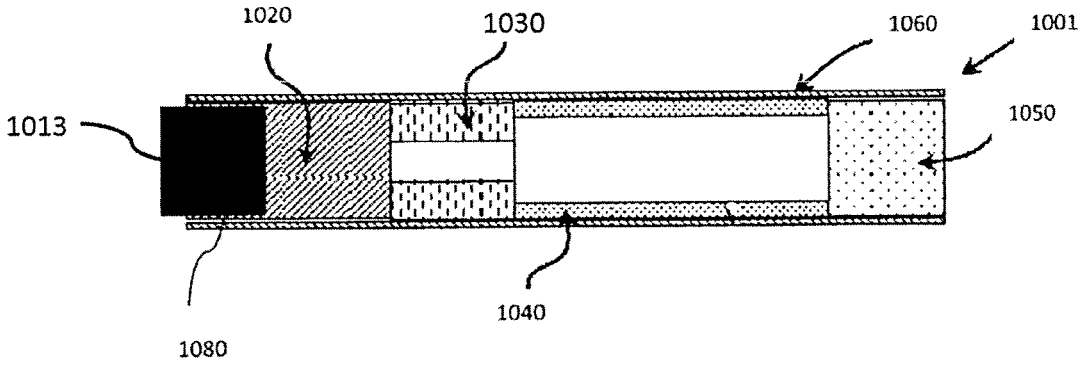
Figure 5:
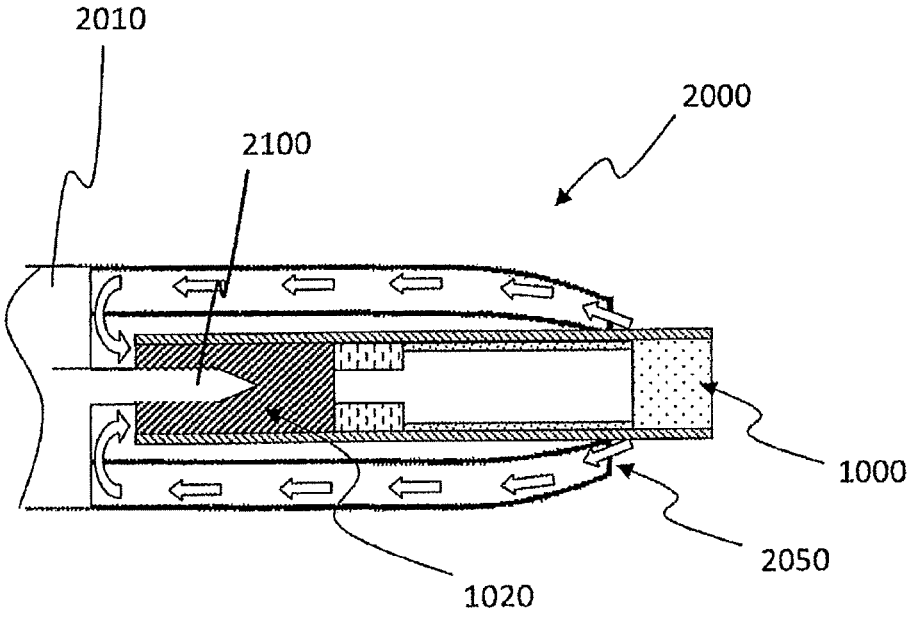
Figure 6:
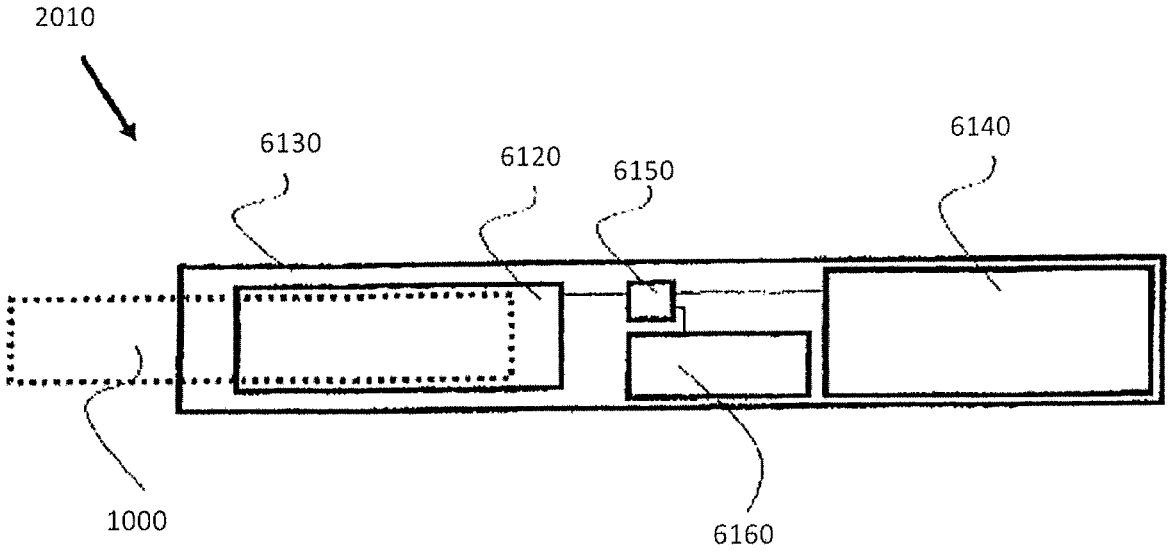

Specific embodiments will be further described, by way of example only, with reference to the accompanying drawings in which:

FIG. 1 shows a schematic cross-section of apparatus for forming an aerosol-generating rod according to a specific embodiment;

FIGS. 2, 3, and 4 illustrate embodiments of aerosol-generating articles that incorporate aerosol-generating rods formed as described herein;

FIG. 5 illustrates an aerosol-generating system comprising an electrically-operated aerosol-generating device and an aerosol-generating article as illustrated in FIG. 2; and FIG. 6 is a schematic cross-sectional diagram of the electrically-operated aerosol-generating device illustrated in FIG. 5.

The apparatus shown in FIG. 1 generally comprises: supply means for providing a continuous sheet of non-tobacco; crimping means for crimping the continuous sheet; rod forming means for gathering the continuous crimped sheet and circumscribing the gathered material with a wrapper to form a continuous rod; and cutting means for severing the continuous rod into a plurality of discrete aerosol-generating rods. The apparatus also comprises transport means for transporting the continuous sheet of material downstream through the apparatus from the supply means to the rod forming means via the crimping means.

As shown in FIG. 1, the supply means for providing a continuous sheet comprises a continuous sheet of non-tobacco 2 mounted on a bobbin 4. The non-tobacco material is a cigarette paper that has been soaked in a liquid formulation comprising nicotine pyruvate, glycerine, and water. The cigarette paper absorbs the liquid formulation and the non-tobacco sheet thus comprises nicotine pyruvate, glycerine and water. The ratio of glycerine to nicotine is 5:1.

The crimping means comprises a pair of rotatable crimping rollers 6. In use, the continuous sheet of non-tobacco material 2 is drawn from the first bobbin 4 and transported downstream to the pair of crimping rollers 6 by the transport mechanism via a series of guide and tensioning rollers. As the continuous sheet of non-tobacco material 2 is fed between the pair of crimping rollers 6, the crimping rollers engage and crimp the sheet 2 to form a continuous crimped sheet 8 having a plurality of spaced-apart ridges or corrugations substantially parallel to the longitudinal axis of the sheet through the apparatus.

The continuous crimped sheet 8 is transported downstream from the pair of crimping rollers 6 towards the rod forming means and fed through a converging funnel or horn 10. The converging funnel 10 gathers the continuous sheet 8 transversely relative to its longitudinal axes. The sheet of material 8 assumes a substantially cylindrical configuration as it passes through the converging funnel 10.

Upon exiting the converging funnel 10, the gathered sheet of non-tobacco material is wrapped in a continuous sheet of wrapper material 12. The wrapper is a paper wrapper and is fed from a bobbin 14 and enveloped around the gathered continuous crimped sheet by an endless belt conveyor or garniture. As shown in FIG. 1, the rod forming means comprises an adhesive application means 16 that applies adhesive to one of the longitudinal edges of the wrapper, so that when the opposed longitudinal edges of the wrapper are brought into contact they adhere to one other to form a continuous rod.

The rod forming means further comprises a drying means 18 downstream of the adhesive application means 16, which in use dries the adhesive applied to the seam of the continuous rod as the continuous rod is transported downstream from the rod forming means to the cutting means.

The cutting means comprises a rotary cutter 20 that severs the continuous rod into a plurality of discrete aerosol-forming rods of unit rod length or multiple unit rod length.

FIG. 2 illustrates an embodiment of a heated aerosol-generating article 1000 comprising an aerosol-generating rod as described herein. The article 1000 comprises four elements; an aerosol-forming substrate 1020 comprising the aerosol-generating rod, a hollow cellulose acetate tube 1030, a spacer element 1040, and a mouthpiece filter 1050. These four elements are arranged sequentially and in coaxial alignment and are assembled by a cigarette paper 1060 to form the aerosol-generating article 1000. The article 1000 has a mouth-end 1012, which a user inserts into his or her mouth during use, and a distal end 1013 located at the opposite end of the article to the mouth end 1012. The embodiment of an aerosol-generating article illustrated in FIG. 2 is particularly suitable for use with an electrically-operated aerosol-generating device comprising a heater for heating the aerosol-forming substrate.

When assembled, the article 1000 is about 45 millimetres in length and has an outer diameter of about 7.2 millimetres.

The aerosol-forming substrate 1020 comprises an aerosol-generating rod formed from a crimped and gathered sheet of nicotine pyruvate and glycerin bearing paper.

An aerosol-generating article 1000 as illustrated in FIG. 2 is designed to engage with an aerosol-generating device in order to be consumed. Such an aerosol-generating device includes means for heating the aerosol-forming substrate 1020 to a sufficient temperature to form an aerosol. Typically, the aerosol-generating device may comprise a heating element that surrounds the aerosol-generating article 1000 adjacent to the aerosol-forming substrate 1020, or a heating element that is inserted into the aerosol-forming substrate 1020.

Once engaged with an aerosol-generating device, a user draws on the mouth-end 1012 of the smoking article 1000 and the aerosol-forming substrate 1020 is heated to a temperature of about 220 degrees Celsius. At this temperature an aerosol comprising nicotine pyruvate, glycerine, and water is evolved. The aerosol is drawn through the filter 1050 and into the user's mouth. It is noted that the temperature that the substrate is heated to is considerably lower than the temperature that would be required to evolve an aerosol from a tobacco substrate.

FIG. 3 illustrates an alternative embodiment of an aerosol-generating article 5000. The aerosol-generating article 5000 comprises four elements arranged in coaxial alignment: an aerosol-forming substrate 5020, a support element 5030, an aerosol-cooling element 5040, and a mouthpiece 5050. These four elements are arranged sequentially and are circumscribed by an outer wrapper 5060 to form the aerosol-generating article 5000. The aerosol-cooling element 5040 acts as a spacer element as described in relation to FIG. 2 as well as an aerosol-cooling element. In use, volatile substances released from the aerosol-forming substrate 5020 pass along the aerosol-cooling element 5040 towards a mouth end 5070 of the aerosol-generating article 5000. The volatile substances may cool within the aerosol-cooling element 5040 to form an aerosol that is inhaled by the user. In the embodiment illustrated in FIG. 5, the aerosol-cooling element comprises a crimped and gathered sheet of polylactic acid circumscribed by a wrapper. The aerosol-forming substrate 5020 comprises an aerosol-generating rod formed from a crimped and gathered sheet of nicotine pyruvate and glycerin bearing paper. The aerosol-generating article 5000 has a proximal or mouth end 5070, which a user inserts into his or her mouth during use, and a distal end 5080 located at the opposite end of the aerosol-generating article 5000 to the mouth end 5070.

FIG. 4 illustrates a second embodiment of an aerosol-generating article 1001. While the article of FIG. 2 or FIG. 3 is intended to be consumed in conjunction with an aerosol-generating device, the article of FIG. 4 comprises a combustible heat source 1080 that may be ignited and transfer heat to the aerosol-forming substrate 1020 to form an inhalable aerosol. The combustible heat source 1080 is a charcoal element that is assembled in proximity to the aerosol-forming substrate at a distal end 1013 of the article 1001. Elements that are essentially the same as elements in FIG. 2 have been given the same numbering as the article in FIG. 2.

FIG. 5 illustrates a portion of an electrically-operated aerosol-generating system 2000 that utilises a heating blade 2100 to heat an aerosol-generating substrate 1020 of an aerosol-generating article 1000. The heating blade is mounted within an aerosol article receiving chamber of an electrically-operated aerosol-generating device 2010. The aerosol-generating device defines a plurality of air holes 2050 for allowing air to flow to the aerosol-generating article 1000. Air flow is indicated by arrows on FIG. 5. The aerosol-generating device comprises a power supply and electronics, which are not illustrated in FIG. 5. The aerosol-generating article 1000 of FIG. 5 is as described in relation to FIG. 2.

In FIG. 6, the components of the aerosol-generating device 2010 are shown in a simplified manner. Particularly, the components of the aerosol-generating device 2010 are not drawn to scale in FIG. 6. Components that are not relevant for the understanding of the embodiment have been omitted to simplify FIG. 6.

As shown in FIG. 6, the aerosol-generating device 2010 comprises a housing 6130. The heating element 6120 is mounted within an aerosol-generating article receiving chamber within the housing 6130. The aerosol-generating article 1000 (shown by dashed lines in FIG. 5) is inserted into the aerosol-generating article receiving chamber within the housing 6130 of the aerosol-generating device 2010 such that the heating element 6120 is directly inserted into the aerosol-forming substrate 1020 of the aerosol-generating article 1000.

Within the housing 6130 there is an electrical energy supply 6140, for example a rechargeable lithium ion battery. A controller 6150 is connected to the heating element 6120, the electrical energy supply 6140, and a user interface 6160, for example a button or display. The controller 6150 controls the power supplied to the heating element 6120 in order to regulate its temperature.

The exemplary embodiments described above are not limiting. In view of the above-discussed exemplary embodiments, other embodiments consistent with the above exemplary embodiment will now be apparent to one of ordinary skill in the art.

The invention claimed is:

1. An aerosol-generating rod, comprising:

a sheet of non-tobacco cellulosic-based material gathered and circumscribed by a wrapper, such that the gathered sheet of non-tobacco material extends along substantially an entire length of the aerosol-generating rod and across substantially an entire transverse cross-sectional area of the aerosol-generating rod, wherein the sheet of non-tobacco cellulosic-based material has a width of at least 25 millimeters and a thickness of from 50 micrometers to 300 micrometers, wherein the gathered sheet of cellulosic-based non-tobacco material comprises a plurality of ridges or corrugations substantially parallel to a cylindrical axis of the aerosol-generating rod, a nicotine salt, and an aerosol-former, and wherein the nicotine salt and the aerosol-former are coated or absorbed onto the sheet of non-tobacco cellulosic-based material.

2. The aerosol-generating rod according to claim 1, wherein the gathered sheet of non-tobacco cellulosic-based material further comprises water.

3. The aerosol-generating rod according to claim 1, wherein the gathered sheet of non-tobacco cellulosic-based material further comprises a flavourant.

4. The aerosol-generating rod according to claim 1, wherein the nicotine salt is selected from the group consisting of nicotine citrate, nicotine pyruvate, nicotine bitartrate, and nicotine salicylate.

5. The aerosol-generating rod according to claim 1, wherein the aerosol-former is one or more aerosol-formers selected from the group consisting of propylene glycol, triethylene glycol, 1,3-butanediol, and glycerine.

6. The aerosol-generating rod according to claim 1, further comprising a menthol flavourant.

7. The aerosol-generating rod according to claim 1, further comprising a further sheet of material, gathered together with the gathered sheet of non-tobacco cellulosic-based material and circumscribed by the wrapper.

8. The aerosol-generating rod according to claim 1, further comprising an inductive susceptor gathered together with the gathered sheet of non-tobacco cellulosic-based material and circumscribed by the wrapper.

9. The aerosol-generating rod according to claim 1, wherein a ratio of aerosol-former to nicotine in the gathered sheet of non-tobacco cellulosic-based material is between 3:1 and 10:1.

10. An aerosol-generating article comprising an aerosol-forming substrate, wherein the aerosol-forming substrate is an aerosol-generating rod according to claim 1.

11. A system comprising an electrically-operated aerosol-generating apparatus and an aerosol-generating article for the apparatus, the aerosol-generating article comprising an aerosol-forming substrate in the form of an aerosol-generating rod according to claim 1.

12. A heated aerosol-generating article comprising a combustible heat source and an aerosol-forming substrate located downstream of the combustible heat source, wherein the aerosol-forming substrate is an aerosol-generating rod according to claim 1.

13. A heated aerosol-generating article for an electrically-operated aerosol-generating system comprising an aerosol-forming substrate, wherein the aerosol-forming substrate is an aerosol-generating rod according to claim 1.

14. A heated aerosol-generating article comprising an aerosol-forming substrate comprising an aerosol generating rod according to claim 1, a hollow cellulose acetate tube, a spacer element, and a mouthpiece filter, wherein the aerosol-forming substrate, the hollow cellulose acetate tube, the spacer element, and the mouthpiece filter are arranged sequentially and in coaxial alignment and are assembled by a cigarette paper to form the aerosol-generating article.

15. A heated aerosol-generating article comprising an aerosol-forming substrate comprising an aerosol generating rod according to claim 1, a support element, an aerosol-cooling element, and a mouthpiece filter, wherein the aerosol-forming substrate, the support element, the aerosol-cooling element, and the mouthpiece filter are arranged sequentially and in coaxial alignment and are assembled by a cigarette paper to form the aerosol-generating article.

* * * * *